US008981997B2

(12) United States Patent
Onaka et al.

(10) Patent No.: US 8,981,997 B2
(45) Date of Patent: Mar. 17, 2015

(54) ANTENNA AND WIRELESS COMMUNICATION DEVICE

(75) Inventors: Kengo Onaka, Yokohama (JP); Kunihiro Komaki, Hakusan (JP); Takashi Ishihara, Machide (JP); Takuya Murayama, Ishikawa-ken (JP); Tsuyoshi Mukai, Hakusan (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 899 days.

(21) Appl. No.: 12/957,032

(22) Filed: Nov. 30, 2010

(65) Prior Publication Data

US 2011/0109512 A1 May 12, 2011

Related U.S. Application Data

(63) Continuation of application No. PCT/JP2009/055101, filed on Mar. 17, 2009.

(30) Foreign Application Priority Data

Jun. 6, 2008 (JP) ..... 2008-149652

(51) Int. Cl.
*H01Q 1/38* (2006.01)
*H01Q 1/24* (2006.01)
(Continued)

(52) U.S. Cl.
CPC ..... *H01Q 1/38* (2013.01); *H01Q 1/243* (2013.01); *H01Q 5/0037* (2013.01); *H01Q 5/0068* (2013.01); *H01Q 7/00* (2013.01)
USPC ..... 343/700 MS; 343/895; 343/702; 343/844; 343/853; 343/742

(58) Field of Classification Search
USPC ..... 343/700 MS, 702, 749, 895, 844, 853, 343/742
See application file for complete search history.

(56) References Cited

U.S. PATENT DOCUMENTS 7,471,252 B2 12/2008 Onaka et al.
2005/0099347 A1* 5/2005 Yamaki ..... 343/749
(Continued)

FOREIGN PATENT DOCUMENTS

JP 2005-005985 A 1/2005
JP 2005-318336 A 11/2005
(Continued)

OTHER PUBLICATIONS

M.Yoshimura; "International Search Report"; PCT/JP2009/055101; May 26, 2009.
(Continued)

*Primary Examiner* — Sue A Purvis
*Assistant Examiner* — Jae Kim
(74) *Attorney, Agent, or Firm* — Studebaker & Brackett PC

(57) ABSTRACT

An antenna includes an antenna element in which a predetermined electrode is provided on a dielectric base member and a substrate in which a predetermined electrode is provided on a base. A feed-terminal connecting electrode to which a feed terminal provided on the lower surface of the antenna element, an external-terminal connecting electrode to which an external electrode is connected, and a ground-terminal connecting electrode to which a ground terminal provided on the lower surface of the antenna element are provided on the upper surface of an ungrounded area of the substrate. A chip inductor is connected between the external-terminal connecting electrode and the feed-terminal connecting electrode, and a chip inductor is connected between the external-terminal connecting electrode and the ground-terminal connecting electrode. The shortcut of a current route achieved by each of the chip inductors is provided.

8 Claims, 8 Drawing Sheets

(51) Int. Cl.
*H01Q 5/00* (2006.01)
*H01Q 7/00* (2006.01)

(56) References Cited

U.S. PATENT DOCUMENTS

| | | | | |
|---|---|---|---|---|
| 2005/0243001 | A1 | 11/2005 | Miyata et al. | |
| 2007/0285335 | A1 * | 12/2007 | Bungo et al. | 343/895 |
| 2008/0122714 | A1 * | 5/2008 | Ishihara et al. | 343/750 |

FOREIGN PATENT DOCUMENTS

| | | | |
|---|---|---|---|
| JP | 2006-211300 | A | 8/2006 |
| WO | 2006/073034 | A1 | 7/2006 |
| WO | 2006/077714 | A1 | 7/2006 |

OTHER PUBLICATIONS

M. Yoshimura; "Written Opinion of the International Searching Authority"; PCT/JP2009/055101; May 26, 2009.

* cited by examiner

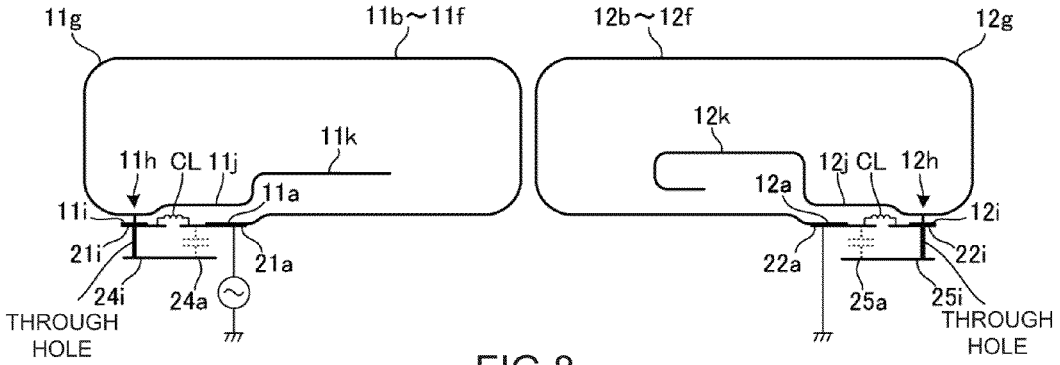
FIG.8
FIG.9A
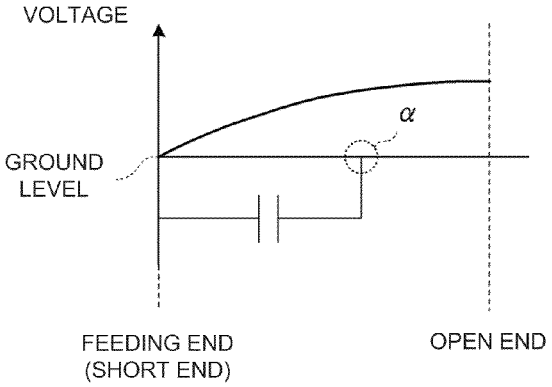
FIG.9B
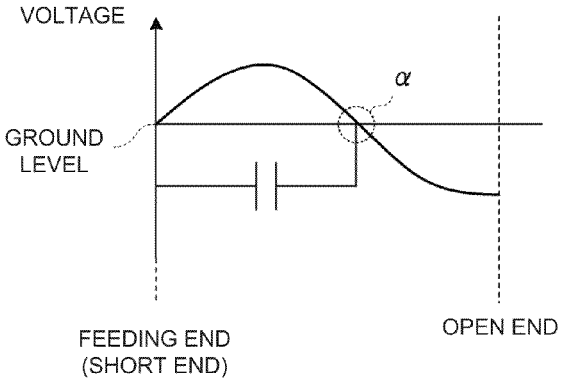

ANTENNA AND WIRELESS COMMUNICATION DEVICE

CROSS REFERENCE TO RELATED APPLICATIONS

The present application is a continuation of International Application No. PCT/JP2009/055099 filed Mar. 17, 2009, which claims priority to Japanese Patent Application No. 2008-149650 filed Jun. 6, 2008, the entire contents of each of these applications being incorporated herein by reference in their entirety.

FIELD OF THE INVENTION

The present invention relates to an antenna for use in a wireless communication device, such as a cellular phone terminal, and to a wireless communication device that includes the same.

BACKGROUND

Examples of a single antenna that supports a plurality of frequency bands are disclosed in Patent Document 1 (International Publication No. WO 2006/073034) and International Publication No. WO 2006/077714 (Patent Document 2).

Here, the configuration of the antenna illustrated in Patent Document 1 is described on the basis of FIG. 1. In the example of FIG. 1, a feed radiation electrode 7 is provided on a rectangular columnar dielectric base member 6. This feed radiation electrode 7 resonates in a fundamental mode and a higher mode. The feed radiation electrode 7 has a first end formed as a feed end 7A for use in connection to a circuit for wireless communication. The feed radiation electrode 7 has a second end formed as an open end 7B. The position of a capacitance-loading portion α is set in advance between the feed end 7A and the open end 7B of the feed radiation electrode 7. The capacitance-loading portion α is connected to a capacitance-loading conductor 12. The capacitance-loading conductor 12 produces a capacitance for use in adjusting the resonant frequency in the fundamental mode between the feed end 7A and the capacitance-loading portion α.

In the antenna illustrated in Patent Document 2, a dielectric base member on which a feed radiation electrode and a non-feed radiation electrode are disposed is arranged in an ungrounded area of a substrate, each of the feed and non-feed electrodes having a spiral slit, and capacitance is formed in the spiral slit.

With the antenna illustrated in Patent Document 1, the magnitude of the capacitance connected between the feed end 7A and the capacitance-loading portion α is specified by the capacitance-loading conductor 12. The use of this can adjust the resonant frequency in the fundamental mode. Setting the position of the capacitance-loading portion α in advance enables the adjustment of the resonant frequency in the fundamental mode while the resonant frequency in a harmonic mode remains substantially constant.

However, in order to adjust or change the load capacitance, it is necessary to alter the shape of the electrode pattern on the rectangular columnar dielectric base member. The same applies to the antenna illustrated in Patent Document 2. For example, when it operates as a double-channel antenna for the 2 GHz band and the 900 MHz band, the resonant frequency in the fundamental mode is set as the 900 MHz band and the resonant frequency in the harmonic mode is set as the 2 GHz band. In order to change the resonant frequency in the fundamental mode by using the load capacitance, as well as in order to change the resonant frequency in the harmonic mode, it is necessary to alter the electrode pattern. Because of this, development and design time is required, and a problem also exists in an increase in cost.

SUMMARY

The invention is directed to an antenna that can allow frequency characteristics to be adjusted and set without altering the shape of an antenna element in which an electrode pattern is disposed on a dielectric base member, and also to a wireless communication device including the antenna.

An antenna consistent with the claimed invention includes an antenna element in which a feed radiation electrode and a non-feed radiation electrode are provided on a dielectric base member. The antenna includes a substrate including an ungrounded area having no ground electrode provided at an end of the substrate, and the antenna element is provided in the ungrounded area of the substrate.

Each of the feed radiation electrode and the non-feed radiation electrode includes a radiation electrode that resonates at a fundamental frequency and a harmonic frequency.

A feed terminal is provided at a feed end of the feed radiation electrode. The feed radiation electrode has a helical or loop shape that develops along a surface of the dielectric base member so as to once extend distant from the feed terminal and then return to a position close to the feed terminal. A first external terminal is provided at an external-terminal leading portion close to the feed terminal.

A ground terminal is provided at a ground end of the non-feed radiation electrode. The non-feed radiation electrode has a helical or loop shape that develops along the surface of the dielectric base member so as to once extend distant from the ground terminal and then return to a position close to the ground terminal. A second external terminal is provided at a position close to the ground terminal.

A feed-terminal connecting electrode to which the feed terminal is connected, first and second external-terminal connecting electrodes to which the first and second external terminals are connected, respectively, and a ground-terminal connecting electrode to which the ground terminal is connected are provided on the substrate. A first inductance element is connected between the first external-terminal connecting electrode and the feed-terminal connecting electrode. A second inductance element is connected between the second external-terminal connecting electrode and the ground-terminal connecting electrode.

According to a more specific embodiment consistent with the claimed invention, the first and second external electrodes may be provided at a position where an electric field distribution of the harmonic radiation electrode exhibits an approximate node in the vicinity of the external-terminal leading portion of the dielectric base member. A capacitance-forming electrode may be provided on the substrate and electrically connected to the external-terminal connecting electrode and cause a capacitance resulting from a base of the substrate to be formed between the feed-terminal connecting electrode and the capacitance-forming electrode.

According to another more specific embodiment consistent with the claimed invention, the capacitance-forming electrode may include a plurality of discrete electrodes. The plurality of electrodes may be connected by at least one chip capacitor.

According to yet another more specific embodiment consistent with the claimed invention, the plurality of discrete electrodes may have different lengths, and the at least one chip capacitor may include a plurality of chip capacitors mounted at a plurality of respective positions.

In another more specific embodiment, a wireless communication device may be configured such that an antenna having a configuration specific to any one of the above embodiments is provided in a casing.

Other features, elements, characteristics and advantages of the present invention will become more apparent from the following detailed description of preferred embodiments of the present invention with reference to the attached drawings.

BRIEF DESCRIPTION OF DRAWINGS

FIG. 7A is a top view and FIG. 7B is a bottom view.

FIG. 8 is an equivalent circuit diagram of the antenna using the substrate illustrated in FIGS. 7A and 7B according to the second exemplary embodiment.

FIGS. 9A and 9B illustrate relationships between a loading position of a capacitance with respect to a radiation electrode and an electric field distribution, where FIG. 9A illustrates an electric field distribution of fundamentals caused by a fundamental radiation electrode, and FIG. 9B illustrates an electric field distribution of harmonics caused by a harmonic radiation electrode.

DETAILED DESCRIPTION

A configuration of an antenna and a wireless communication device including the antenna according to a first exemplary embodiment is described with reference to FIGS. 2 to 6B.

Figure 1:
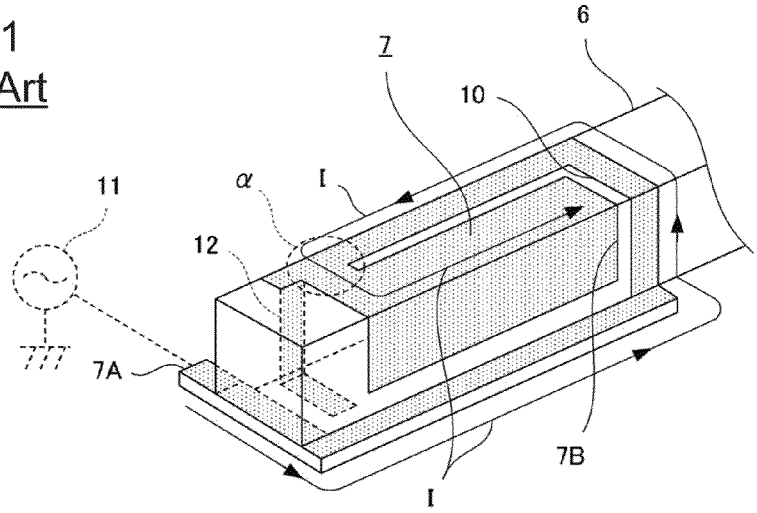
FIG.1 Prior Art
FIG. 1 illustrates a configuration of an antenna disclosed in Patent Document 1.
Figure 2:
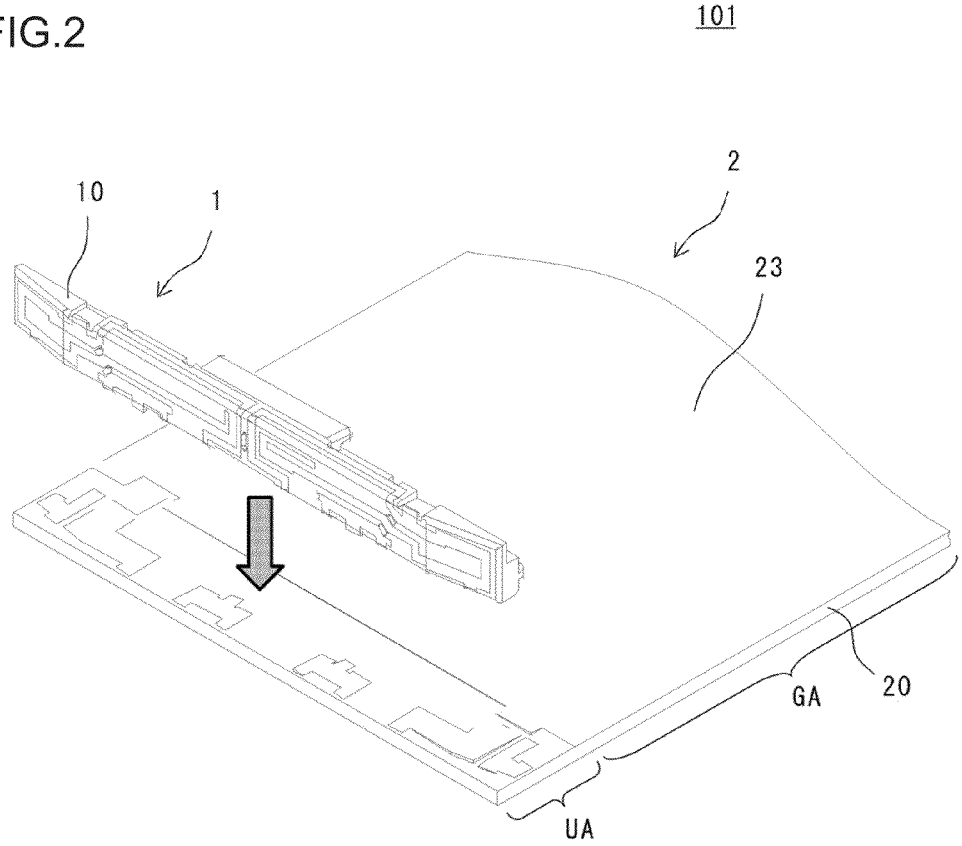
FIG. 2 is a partially exploded perspective view that illustrates a configuration of an antenna to be incorporated in a casing of a wireless communication device, such as a cellular phone terminal, according to a first exemplary embodiment.

FIG. 2 is a partially exploded perspective view that illustrates the configuration of an antenna to be incorporated in the casing of a wireless communication device, such as a cellular phone terminal. An antenna 101 includes an antenna element 1 in which a predetermined electrode is disposed (provided) on a dielectric base member 10 having a shape extending the shape of the casing of the wireless communication device and a substrate 2 in which a predetermined electrode is disposed, or provided on a base 20.

The substrate 2 has a grounded area GA where a ground electrode 23 is provided and an ungrounded area UA where no ground electrode 23 is disposed. The ungrounded area UA extends along one side of the substrate 2. The antenna element 1 can be implemented by surface mounting in a position existing in the ungrounded area UA and being remote from the grounded area GA as far as possible.

To incorporate antenna 101 into a folding-type cellular phone terminal, it can be arranged in a position adjacent to a hinge portion.

Figure 3A:
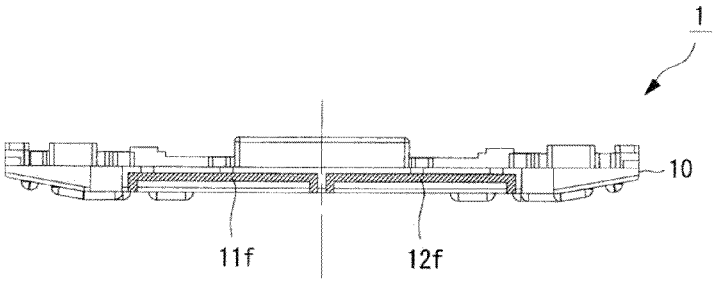
FIGS. 3A to 3F show six-views of the antenna element illustrated in FIG. 2.
Figure 3E:
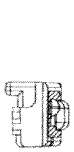
Figure 3B:
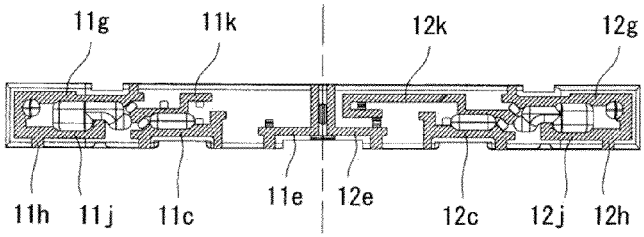
Figure 3F:
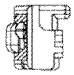
Figure 3C:
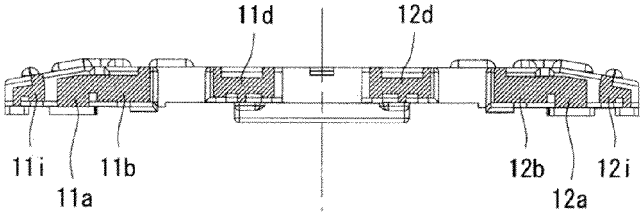
Figure 3D:
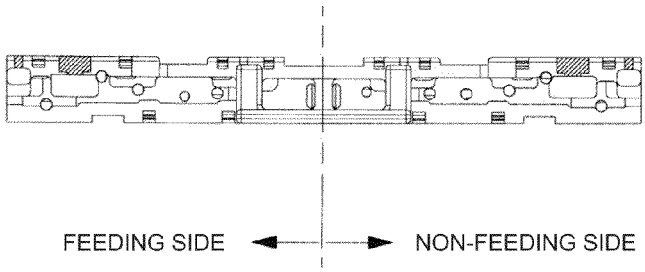

FIGS. 3A to 3F constitute a six-view drawing of the antenna element 1 illustrated in FIG. 2. FIG. 3A is a top view, FIG. 3B is a front view, FIG. 3C is a bottom view, FIG. 3D is a rear view, FIG. 3E is a left side view, and FIG. 3F is a right side view.

The dielectric base member 10 and an electrode pattern disposed thereon are symmetrical with respect to alternate long and short dashed line in each of FIGS. 3A to 3D. In this example, the single dielectric base member 10 is used and the antenna element 1 is configured such that a feeding-side (feed side) antenna element is at the left side to the alternate long and short dashed lines and a non-feeding side (non-feed side) antenna element is at the right side thereto.

First, the feeding side will be described. With reference to FIG. 3B, a first external terminal 11*i*, a feed terminal 11*a*, and electrodes 11*b* and 11*d* are disposed on the bottom surface of the dielectric base member 10. FIG. 3B shows electrodes 11*c*, 11*e*, 11*g*, 11*j*, and 11*k* disposed on the front surface of the dielectric base member 10, and an external-terminal leading portion 11*h* extending from the front surface to the bottom surface.

As shown in FIG. 3A, an electrode 11*f* is disposed on the upper surface of the dielectric base member 10.

The above terminals and electrodes are contiguous as follows: the feed terminal 11*a* to the electrode 11*b* to the electrodes 11*c* to 11*d* to 11*e* to 11*f* to 11*g* to 11*j* to 11*k*. The external-terminal leading portion 11*h* is electrically connected to the first external terminal 11*i* on the bottom surface. The electrode 11*k* is disposed so as to be contiguous with the electrode 11*j*. In such a manner, the feed radiation electrode having a helical or loop shape is configured.

The non-feeding side will now be described below. As shown in FIG. 3C, a second external terminal 12*i*, a ground terminal 12*a*, and electrodes 12*b* and 12*d* are disposed, or provided on the bottom surface of the dielectric base member 10. FIG. 3B shows electrodes 12*c*, 12*e*, 12*g*, 12*j*, and 12*k* are disposed, or provided on the front surface of the dielectric base member 10, and an external-terminal leading portion 12*h* extending from the front surface to the bottom surface.

As shown in FIG. 3A, an electrode 12*f* is disposed, or provided on the upper surface of the dielectric base member 10.

The above terminals and electrodes are contiguous as follows: the ground terminal 12*a* to the electrode 12*b* to the electrodes 12*c* to 12*d* to 12*e* to 12*f* to 12*g* to 12*j* to 12*k*. The external-terminal leading portion 12*h* is electrically connected to the second external terminal 12*i* on the bottom surface. The electrode 12*k* is disposed, or provided so as to be contiguous with the electrode 12*j*. In such a manner, the non-feed radiation electrode having a helical or loop shape is configured.

Figure 4:
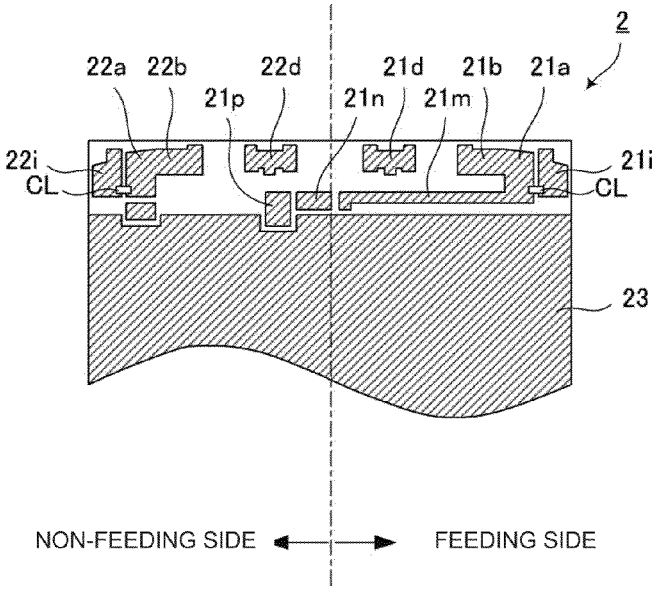
FIG. 4 is a top view showing a pattern of electrodes provided on a substrate illustrated in FIG. 2.

FIG. 4 is a top view that illustrates a pattern of electrodes disposed on the substrate 2 illustrated in FIG. 2. A configuration at the feeding side is now described. As shown in FIG. 4, a first external-terminal connecting electrode 21*i*, a feed-terminal connecting electrode 21*a*, and electrodes 21*b* and 21*d* are disposed on the upper surface in the ungrounded area (UA) of the substrate 2. An electrode 21*m* extends from the feed-terminal connecting electrode 21*a*, and discrete electrodes 21*n* and 21*p* are disposed apart from an end of the electrode 21*m*.

A chip inductor CL is mounted between the first external-terminal connecting electrode 21*i* and the feed-terminal connecting electrode 21*a*.

The above first external-terminal connecting electrode 21*i* is connected to the first external terminal 11*i* illustrated in FIG. 3C. The feed-terminal connecting electrode 21*a* is connected to the feed terminal 11*a* of the antenna element 1. Similarly, the electrodes 21*b* and 21*d* on the substrate are connected to the electrodes 11*b* and 11*d* of the antenna element 1, respectively.

A feeder circuit (transmitter/receiver circuit) (not shown) is connected between the electrode 21*m* extending from the above feed-terminal connecting electrode 21*a* and the ground electrode 23. A chip capacitor or chip inductor (not shown) for a matching circuit is mounted between each of the discrete electrodes 21*n* and 21*p* and each of the ground electrode 23 and the electrode 21*m*.

A configuration at the non-feeding side is now described. As shown in FIG. 4, second external-terminal connecting electrode 22*i*, a ground-terminal connecting electrode 22*a*, and electrodes 22*b* and 22*d* are disposed on the upper surface in the ungrounded area (UA) of the substrate 2.

The above second external-terminal connecting electrode 22*i* is connected to the second external terminal 12*i* illustrated in FIG. 3C. The ground-terminal connecting electrode 22*a* is connected to the ground terminal 12*a* of the antenna element 1. Similarly, the electrodes 22*b* and 22*d* on the substrate are connected to the electrodes 12*b* and 12*d* of the antenna element 1, respectively.

A chip inductor CL is connected, for example mounted, between the second external-terminal connecting electrode 22*i* and the ground-terminal connecting electrode 22*a*.

Figure 5:
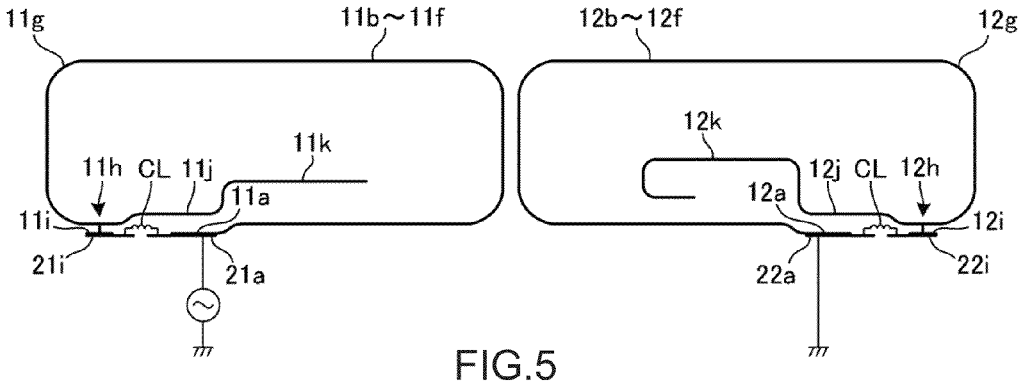
FIG. 5 is an equivalent circuit diagram of an antenna illustrated in FIGS. 2 to 4.

FIG. 5 is an equivalent circuit diagram of the antenna 101 illustrated in FIGS. 2 to 4. First, the feeding side is described with reference to the left-hand side of FIG. 5.

The loop from the feed terminal 11*a* to the electrode 11*k* through the electrodes 11*b* to 11*g* and 11*j* forms a fundamental radiation electrode that resonates with a substantially ¼ wavelength and a harmonic radiation electrode that resonates with a substantially ¾ wavelength.

The first external terminal 11*i* is electrically connected to the first external-terminal connecting electrode 21*i* on the upper surface of the substrate 2.

Similarly, the non-feeding side shown on the right-hand side of FIG. 5 is configured such that the loop from the ground terminal 12*a* to the electrode 12*k* through the electrodes 12*b* to 12*g* and 12*j* forms a fundamental radiation electrode that resonates with a ¼ wavelength and a harmonic radiation electrode that resonates with a ¾ wavelength.

The second external terminal 12*i* is electrically connected to the second external-terminal connecting electrode 22*i* on the upper surface of the substrate 2.

As illustrated in FIG. 5, the fundamental radiation electrode and the harmonic radiation electrode made up of the feed terminal 11*a* and the electrodes 11*b* to 11*k* are fed directly from the feed terminal 11*a*.

If each of the chip inductors CL is not present in FIG. 5, in the radiation electrode 11 (11*a*, 11*b* to 11*f*, 11*g*, 11*j*) at the feeding side, a current passes around the loop from the feed end to the open end. When the chip inductor CL is connected between the first external-terminal connecting electrode 21*i* and the feed-terminal connecting electrode 21*a*, a shortcut route passing through the chip inductor is present between a point within the above radiation electrode 11 and the feed end. Therefore, the route passing around the above loop and the route passing through the chip inductor are present, so the equivalent electrical length of the radiation electrode 11 is shortened and the resonant frequency in the fundamental mode is increased.

The proportion of the amount of current flowing through the route passing through the chip inductor of the above two current routes increases with a reduction in inductance of the above chip inductor. This leads to a further reduction in the equivalent electrical length of the radiation electrode and a further increase in the resonant frequency in the fundamental mode.

Because the resonant frequency in the harmonic mode is higher than that in the fundamental mode, the proportion of the amount of current flowing through the above chip inductor is small. Therefore, in the range of an inductance value of a chip inductor used in order to control the resonant frequency in the fundamental mode, the resonant frequency in the harmonic mode remains substantially unchanged.

Figure 6A:
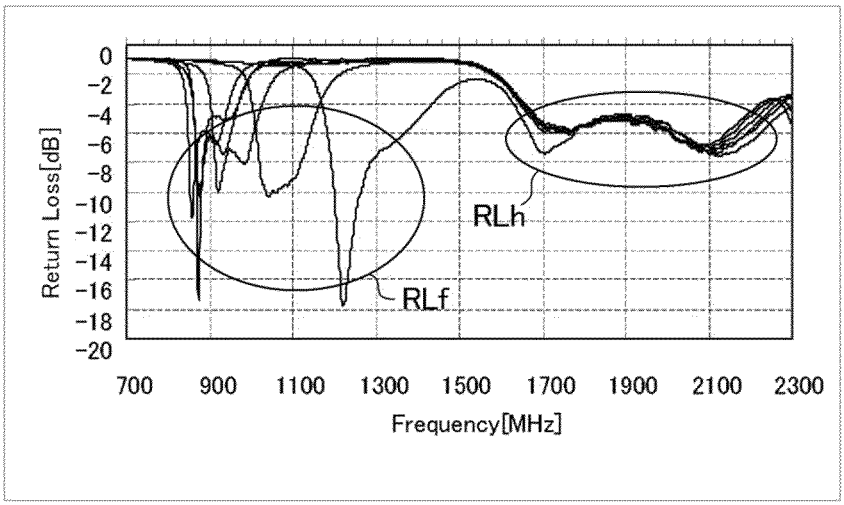
FIGS. 6A and 6B are graphs illustrating return-loss characteristics of an antenna when changing the inductance value of the chip inductor illustrated in FIGS. 4 and 5.
Figure 6B:
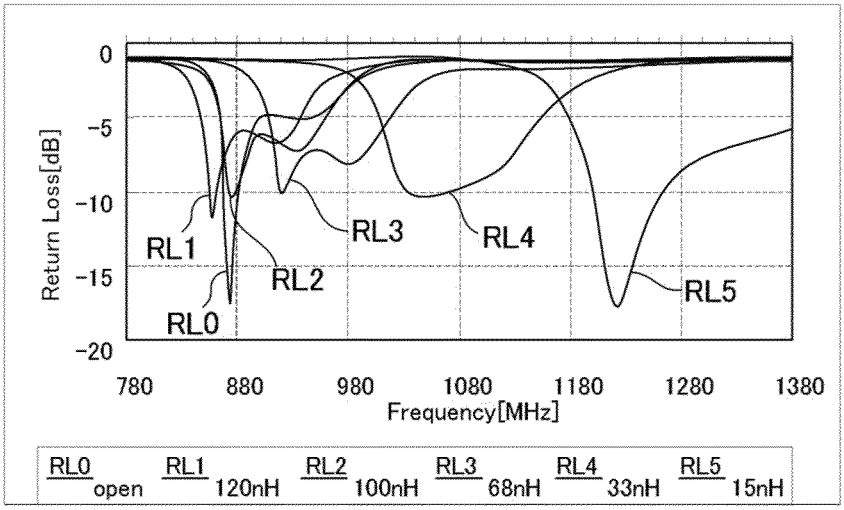

FIGS. 6A and 6B illustrate return-loss characteristics of the antenna when the inductance value of the chip inductor CL illustrated in FIG. 4 is changed. In FIG. 6A, a smaller return-loss characteristic indicated by RLf appearing in lower frequencies results from resonance in the fundamental mode, whereas a smaller return-loss characteristic indicated by RLh appearing in higher frequencies results from resonance in the harmonic mode.

From the above-described reason, the amount of current allowed to flow through the shortcut route increases with a reduction in inductance value of the chip inductor CL, so the resonant frequency in the fundamental mode is increased. The characteristic of the return loss RLf in lower frequencies varies with a change in inductance value of the chip inductor CL, whereas that of the return loss RLh in higher frequencies remains substantially unchanged.

FIG. 6B illustrates how the return loss RLf in the fundamental mode illustrated in FIG. 6A is changed. When the inductance value of the chip inductor CL illustrated in FIGS. 4 and 5 is open, the return loss exhibits the characteristic indicated by RL0 in the drawing; when the inductance value of the chip inductor is 120n, the return loss is the one indicated by RL1; when the inductance value of the chip inductor is 100n, 68n, 33n, and 15n, the return loss varies as indicated by RL2, RL3, RL4, and RL5, respectively. That is, the resonant frequency in the fundamental mode increases with a reduction in inductance value of the chip inductor.

It is assumed that the reason why the resonant frequency in the fundamental mode when the chip inductor of 120nH is used is lower than that when the chip inductor being open is used is that the chip inductor acts as a capacitance in an equivalent manner by its capacitance component.

Setting the inductance value of the chip inductor CL in such a way enables the frequency in lower frequencies to be set without any alterations to the antenna element 1.

Figure 7B:
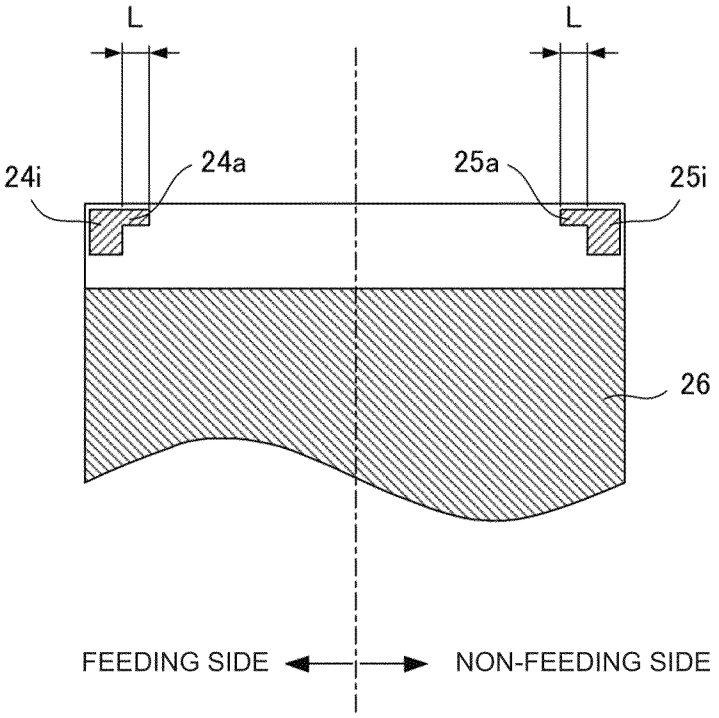
FIGS. 7A and 7B illustrate a pattern of electrodes provided on a substrate for use in an antenna according to a second exemplary embodiment, where
Figure 7A:
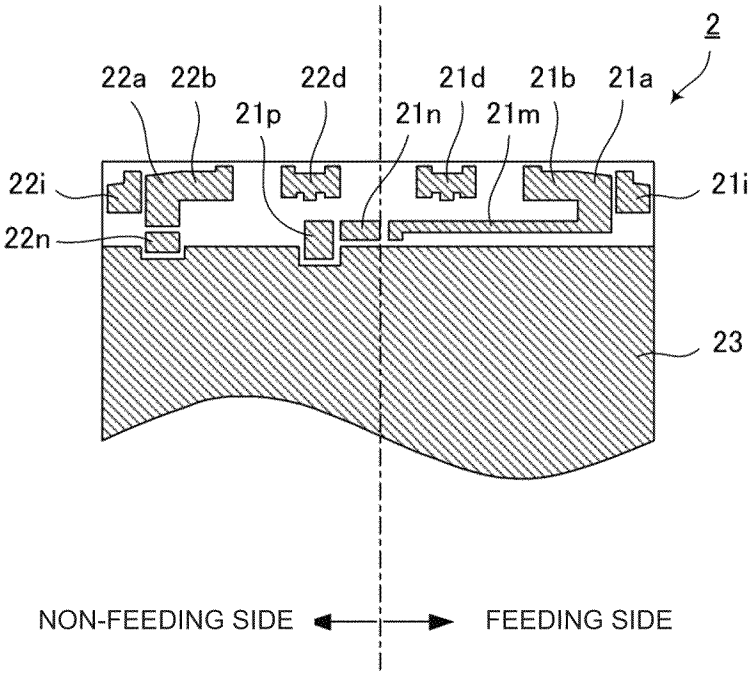

FIGS. 7A and 7B illustrate a pattern of electrodes disposed, or provided on the substrate 2 of an antenna according to a second exemplary embodiment. FIG. 7A is a top view and FIG. 7B is a bottom view. The configuration of the antenna element 1 to be implemented on the substrate 2 is substantially the same as that illustrated in FIG. 3 in the first exemplary embodiment. The pattern of electrodes on the upper surface of the substrate 2 is substantially the same as that illustrated in FIG. 4 in the first exemplary embodiment.

A feature of the antenna according to the second exemplary embodiment is that a capacitance is formed by electrodes on the upper and lower surfaces of the substrate 2 and it is loaded on the antenna.

A configuration at the feeding side will now be described. The first external-terminal connecting electrode 21*i*, the feed-terminal connecting electrode 21*a*, and the electrodes 21*b* and 21*d* are disposed on the upper surface in the ungrounded area of the substrate 2. The electrode 21*m* extends from the feed-terminal connecting electrode 21*a*, and the discrete electrodes 21*n* and 21*p* are disposed apart from the end of the electrode 21*m*.

The above first external-terminal connecting electrode 21*i* is connected to the first external terminal 11*i* illustrated in FIG. 3C. The feed-terminal connecting electrode 21*a* is connected to the feed terminal 11*a* of the antenna element 1. Similarly, the electrodes 21*b* and 21*d* on the substrate are connected to the electrodes 11*b* and 11*d* of the antenna element 1, respectively.

A configuration at the non-feeding side is now described. As shown in FIG. 7A, the second external-terminal connecting electrode 22*i*, the ground-terminal connecting electrode 22*a*, and the electrodes 22*b* and 22*d* are disposed on the upper surface in the ungrounded area (UA) of the substrate 2. A discrete electrode 22*n* is disposed between the ground-terminal connecting electrode 22*a* and the ground electrode 23.

The above second external-terminal connecting electrode 22*i* is connected to the second external terminal 12*i* illustrated in FIG. 3C. The ground-terminal connecting electrode 22*a* is connected to the ground terminal 12*a* of the antenna element 1. Similarly, the electrodes 22*b* and 22*d* on the substrate are connected to the electrodes 12*b* and 12*d* of the antenna element 1, respectively.

As illustrated in FIG. 7B, at the feeding side of the lower surface of the substrate 2, an electrode 24*i* is disposed at a position that faces the first external-terminal connecting electrode 21*i* on the upper surface, and an electrode 24*a* is disposed at a position that faces the feed-terminal connecting electrode 21*a* on the upper surface. The above first external-terminal connecting electrode 21*i* and its facing electrode 24*i* are electrically connected to each other through a through hole (not shown in FIG. 7B). Because the electrodes 24*i* and 24*a* are contiguous with to each other, a capacitance is formed in a portion where the electrode 24*a* faces the feed-terminal connecting electrode 21*a* such that the base of the substrate 2 (i.e., the base 20 illustrated in FIG. 2) is disposed therebetween.

As illustrated in FIG. 7B, at the non-feeding side of the lower surface of the substrate 2, an electrode 25*i* is disposed at a position that faces the second external-terminal connecting electrode 22*i* on the upper surface, and an electrode 25*a* is disposed at a position that faces the ground-terminal connecting electrode 22*a* on the upper surface. The above second external-terminal connecting electrode 22*i* and its facing electrode 25*i* are electrically connected to each other through a through hole (not shown in FIG. 7B). Because the electrodes 25*i* and 25*a* are contiguous with each other, a capacitance is formed in a portion where the electrode 25*a* faces the ground-terminal connecting electrode 22*a* such that the base of the substrate 2 (the base 20 illustrated in FIG. 2) is disposed therebetween.

FIG. 8 is an equivalent circuit diagram of the antenna using the substrate 2 illustrated in FIGS. 7A and 7B according to the second exemplary embodiment. The configuration of the antenna element to be implemented on the substrate is substantially the same as that illustrated in the first exemplary embodiment.

First, with reference to the left-hand side of FIG. 8, the feeding side is described. The loop from the feed terminal 11*a* to the electrode 11*k* through the electrodes 11*b* to 11*g* and 11*j* forms a fundamental radiation electrode that resonates with a substantially ¼ wavelength and a harmonic radiation electrode that resonates with a substantially ¾ wavelength.

The first external terminal 11*i* is electrically connected to the first external-terminal connecting electrode 21*i* on the upper surface of the substrate 2. This first external-terminal connecting electrode 21*i* is electrically connected to the electrodes 24*i* on the lower surface of the substrate 2 through a through hole. As indicated by broken lines representing the symbol of a capacitor in the drawing, a capacitance is formed between the capacitance-forming electrode 24*a*, which extends from the electrode 24*i*, and the feed-terminal connecting electrode 21*a* on the upper surface of the substrate 2.

Similarly, the non-feeding side shown in the right-hand side of FIG. 8 is configured such that the loop from the ground terminal 12*a* to the electrode 12*k* through the electrodes 12*b* to 12*g* and 12*j* forms a fundamental radiation electrode that resonates with a ¼ wavelength and a harmonic radiation electrode that resonates with a ¾ wavelength.

The second external terminal 12*i* is electrically connected to the second external-terminal connecting electrode 22*i* on the upper surface of the substrate 2. This second external-terminal connecting electrode 22*i* is electrically connected to the electrodes 25*i* on the lower surface of the substrate 2 through a through hole. As indicated by dashed lines representing the symbol of a capacitor in the drawing, a capacitance is formed between the capacitance-forming electrode 25*a*, which extends from the electrode 25*i*, and the ground-terminal connecting electrode 22*a* on the upper surface of the substrate 2.

FIG. 9A illustrates an electric field distribution of fundamentals caused by the fundamental radiation electrode described above, and FIG. 9B illustrates an electric field distribution of harmonics caused by the harmonic radiation electrode. As is clear from reference to FIG. 8, the fundamental radiation electrode resonates with a ¼ wavelength, and a capacitance is loaded between the external-terminal leading portion 11*h* of the fundamental radiation electrode and the feed end. This loaded capacitance changes the resonant frequency in the fundamental mode.

For the harmonic radiation electrode resonating with a ¾ wavelength, the external-terminal leading portion 11*h* is set such that a node of the electric field distribution of harmonics is in the vicinity of the external-terminal leading portion 11*h*. Therefore, the resonant frequency of harmonics is not substantially affected by the load capacitance.

In such a manner, the resonant frequency in the fundamental mode can be adjusted independently of the resonant frequency in the harmonic mode.

Figure 10:
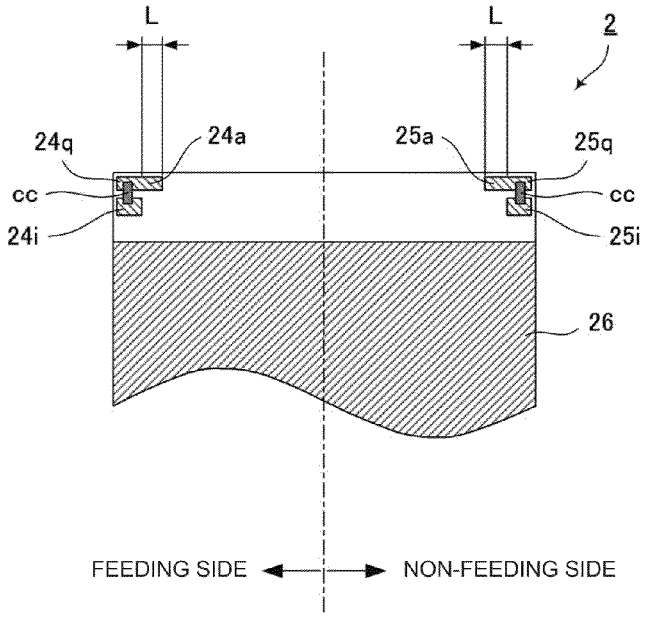
FIG. 10 is a bottom view of a substrate for use in an antenna according to a third exemplary embodiment.

FIG. 10 is a bottom view of the substrate 2 of an antenna according to a third exemplary embodiment. It is different from the configuration illustrated in FIG. 7B in the second exemplary embodiment in that a capacitance-forming electrode is made up of a plurality of electrodes being discrete. In the example illustrated in FIG. 10, the capacitance-forming electrode 24*i* illustrated in FIG. 7B is separated into a capacitance-forming electrode 24*q* contiguous with the capacitance-forming electrode 24*a* and a capacitance-forming electrode 24*i*, and a chip capacitor CC is mounted between these capacitance-forming electrode 24*q* and capacitance-forming electrode 24*i*.

Similarly, also at the non-feeding side, the capacitance-forming electrode 25*i* illustrated in FIG. 7B is separated into a capacitance-forming electrode 25*q* liked to the capacitance-forming electrode 25*a* and a capacitance-forming electrode 25*i*, and a chip capacitor CC is mounted between these capacitance-forming electrode 25*q* and capacitance-forming electrode 25*i*.

Figure 11:
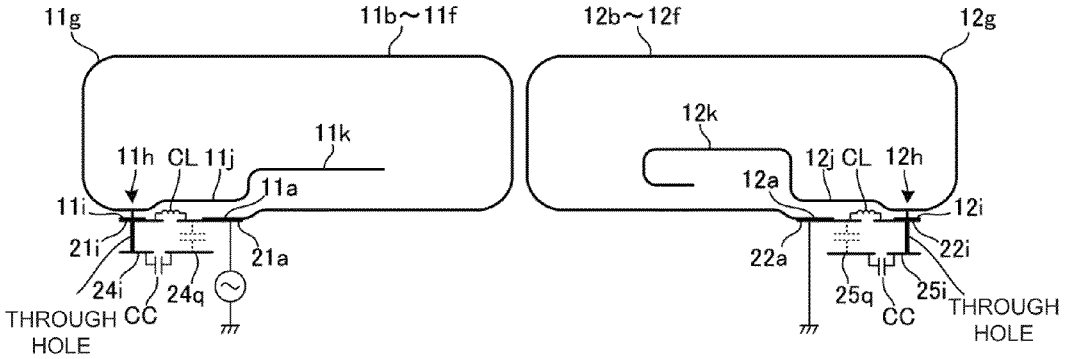
FIG. 11 is an equivalent circuit diagram of the antenna according to the third exemplary embodiment.

FIG. 11 is an equivalent circuit diagram of the antenna using the substrate 2 illustrated in FIG. 10 according to the third exemplary embodiment. The configuration of the antenna element to be implemented on the substrate is substantially the same as that illustrated in the first exemplary embodiment. As illustrated in the left-hand side of FIG. 11, at the feeding side, the chip capacitor CC is connected between the capacitance-forming electrodes 24*i* and 24*q*, and a capacitance resulting from the substrate is formed between the capacitance-forming electrode 24*a* and the feed-terminal connecting electrode 21*a*. Accordingly, both the chip inductor CL and a series circuit made up of the capacitance resulting from the substrate and the capacitance of the chip capacitor CC are connected between the feed terminal 11*a* and the external-terminal leading portion 11*h*. Therefore, the proportion of the shortcut is specified by the chip inductor CL, and the load capacitance with respect to the radiation electrode is set by the capacitance of the substrate and the capacitance of the chip capacitor CC.

Similarly, at the non-feeding side illustrated in the right-hand side of FIG. 11, the chip capacitor CC is connected between the capacitance-forming electrodes 25*i* and 25*q*, and a capacitance resulting from the substrate is formed between the capacitance-forming electrode 25*a* and the ground-terminal connecting electrode 22*a*. Accordingly, both the chip inductor CL and a series circuit made up of the capacitance resulting from the substrate 2 and the capacitance of the chip capacitor CC are connected between the ground terminal 12*a* and the external-terminal leading portion 12*h*. Therefore, the proportion of the shortcut is specified by the chip inductor CL, and the load capacitance with respect to the radiation electrode is set by the capacitance of the substrate and the capacitance of the chip capacitor CC.

In such a way, mounting not only a chip inductor having a predetermined inductance but also a chip capacitor having a predetermined capacitance enables the load capacitance between the feed end and the external-terminal leading portion or between the ground point and the external-terminal leading portion to be specified. Hence, the resonant frequency in the fundamental mode of the electrodes on the substrate 2 can also be set and adjusted without altering the pattern of the electrodes.

Figure 12:
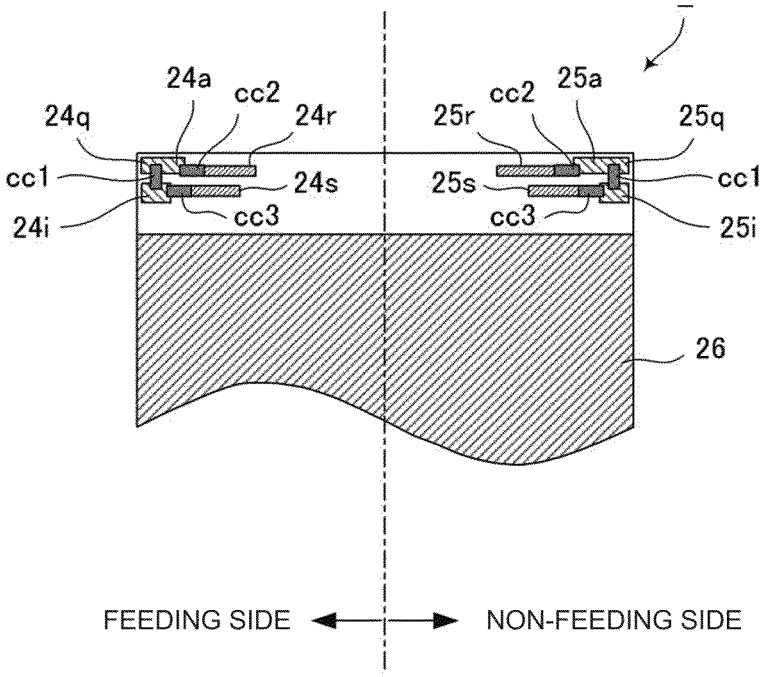
FIG. 12 is a bottom view of a substrate for use in an antenna according to a fourth exemplary embodiment.

FIG. 12 is a bottom view of a substrate portion of an antenna according to a fourth exemplary embodiment. In this example, as a capacitance-forming electrode, discrete capacitance-forming electrodes 24*r* and 24*s* are disposed at the feeding side, and discrete capacitance-forming electrodes 25*r* and 25*s* are disposed at the non-feeding side. The capacitance-forming electrodes 24*r* and 24*s* face an electrode that extends from the feed-terminal connecting electrode on the upper surface of the substrate 2, whereas the capacitance-forming electrodes 25*r* and 25*s* face an electrode that extends from the ground-terminal connecting electrode on the upper surface of the substrate 2. The electrode pattern on the upper surface of the substrate 2 is substantially the same as that illustrated as the first exemplary embodiment in FIG. 4.

At the feeding side, a chip capacitor CC2 is mounted between the capacitance-forming electrodes 24*q* and 24*r*, and a chip capacitor CC3 is mounted between the capacitance-forming electrodes 24*i* and 24*s*. The use of capacitance of these chip capacitors CC1 to CC3 enables the load capacitance between the external-terminal leading portion (11*h*) and the feed terminal (11*a*) of the antenna element to be specified with high accuracy.

Similarly, at the non-feeding side, a chip capacitor CC2 is mounted between capacitance-forming electrodes 25*q* and 25*r*, and a chip capacitor CC3 is mounted between the capacitance-forming electrodes 25*i* and 25*s*. The use of capacitance of these chip capacitors CC1 to CC3 enables the load capacitance between the external-terminal leading portion (12*h*) and the ground terminal (12*a*) of the antenna element to be specified with high accuracy.

Embodiments consistent with the claimed invention can allow for adjusting the resonant frequency in the fundamental mode merely by alteration in the electrode pattern on the substrate while the electrode pattern on the antenna element remains unchanged.

Also, the resonant frequency in the fundamental mode can be controlled solely and independently while the resonant frequency in the harmonic mode remains substantially constant.

Additionally, it is not necessary to alter the antenna element to make an adjustment of the resonant frequency in the fundamental mode, so the lead time can be shortened and cost reduction can be achieved.

While exemplary embodiments of the invention have been described above, it is to be understood that variations and modifications will be apparent to those skilled in the art without departing from the scope and spirit of the invention.

The scope of the invention, therefore, is to be determined solely by the following claims and their equivalents.

The invention claimed is:

1. An antenna, comprising:

an antenna element including a feed radiation electrode and a non-feed radiation electrode provided on a dielectric base member; and a substrate including an ungrounded area having no ground electrode at an end of the substrate, the antenna element being provided in the ungrounded area of the substrate, wherein each of the feed radiation electrode and the non-feed radiation electrode includes a radiation electrode that resonates at a fundamental frequency and a harmonic frequency, a feed terminal is provided at a feed end of the feed radiation electrode, the feed radiation electrode has a helical or loop shape that develops along a surface of the dielectric base member so as to once extend from the feed terminal and then return to a position adjacent to the feed terminal, and a first external terminal is provided at an external-terminal leading portion adjacent to the feed terminal, a ground terminal is provided at a ground end of the non-feed radiation electrode, the non-feed radiation electrode has a helical or loop shape that develops along the surface of the dielectric base member so as to once extend from the ground terminal and then return to a position adjacent to the ground terminal, and a second external terminal is provided at a position adjacent to the ground terminal, a feed-terminal connecting electrode to which the feed terminal is connected, first and second external-terminal connecting electrodes to which the first and second external terminals are connected, respectively, and a ground-terminal connecting electrode to which the ground terminal is connected are provided on the substrate, a first inductance element is connected between the first external-terminal connecting electrode and the feed-terminal connecting electrode, and a second inductance element is connected between the second external-terminal connecting electrode and the ground-terminal connecting electrode, a first route for electrical current extends from the feed end of the feed radiation electrode and around the feed radiation electrode loop, and a second route for electrical current through the first inductance element is present between a point within the feed radiation electrode and the feed end of the feed radiation electrode.

2. The antenna according to claim 1, wherein the first and second external electrodes are provided at a position where an electric field distribution of the harmonic radiation electrode exhibits a node at or adjacent a position of the external-terminal leading portion of the dielectric base member, and said antenna further comprises:

a capacitance-forming electrode provided on the substrate and electrically connected to the external-terminal connecting electrode and causing a capacitance resulting from a base of the substrate to be formed between the feed-terminal connecting electrode and the capacitance-forming electrode.

3. The antenna according to claim 2, wherein the capacitance-forming electrode comprises a plurality of discrete electrodes, and the plurality of electrodes are connected by at least one chip capacitor.

4. The antenna according to claim 3, wherein the plurality of electrodes being discrete have different lengths, and the at least one chip capacitor comprises a plurality of chip capacitors mounted at a plurality of respective positions.

5. A wireless communication device in which the antenna according to claim 1 is provided in a casing.

6. A wireless communication device in which the antenna according to claim 2 is provided in a casing.

7. A wireless communication device in which the antenna according to claim 3 is provided in a casing.

8. A wireless communication device in which the antenna according to claim 4 is provided in a casing.

* * * * *